United States Patent [19]

Kristofek

[11] 4,314,223

[45] Feb. 2, 1982

[54] THERMAL PROTECTIVE DEVICE FOR LIGHTING FIXTURES

[75] Inventor: Paul J. Kristofek, Hickory Hills, Ill.

[73] Assignee: McGraw-Edison Company, Rolling Meadows, Ill.

[21] Appl. No.: 215,163

[22] Filed: Dec. 11, 1980

[51] Int. Cl.[3] ..... H01H 61/01

[52] U.S. Cl. ..... 337/113; 337/381

[58] Field of Search ..... 337/84, 88, 92, 112, 337/113, 381

[56] References Cited

U.S. PATENT DOCUMENTS

| | | | |
|---|---|---|---|
| 1,683,992 | 9/1928 | Shoenberg et al. | 337/85 X |
| 1,733,743 | 10/1929 | Ludwig | 337/85 |
| 2,458,724 | 1/1949 | Parissi et al. | 337/113 X |
| 4,131,868 | 12/1978 | Dombrowski et al. | 337/113 |

*Primary Examiner*—George Harris

*Attorney, Agent, or Firm*—Ronald J. LaPorte; Jon Carl Gealow; Charles W. MacKinnon

[57] ABSTRACT

A thermal protective device for interrupting current to the lamp circuit of an electrical lighting fixture when the temperature at a preselected location in the fixture reaches a predetermined level, comprises a receptacle including a pair of female terminals coupled electrically to the lamp circuit. A normally open switch having a movable contact arm with a hooked end portion is coupled to one of the terminals to maintain the lamp circuit normally open. A plug adapted for joinder with the receptacle includes a pair of male terminals arranged for receipt by the female terminals of the receptacle. A thermal protector included in the plug is operable from a closed to an open condition when the temperature reaches the aforesaid predetermined level. The thermal protector is connected electrically across the male terminals. An actuator and latch arm extending from the plug is received in the receptacle upon joinder of the receptacle and plug. The actuator and latch arm moves the switch contact arm to close the switch thereby completing the lamp circuit through the thermal protector. At the same time, the actuator and latch arm engages the hooked end portion of the contact arm to disengageably couple the receptacle and plug.

13 Claims, 7 Drawing Figures

THERMAL PROTECTIVE DEVICE FOR LIGHTING FIXTURES

BACKGROUND OF THE INVENTION

This invention relates generally to thermal protective device for lighting fixtures and more particularly to such devices for use with recessed lighting fixtures.

It has been recognized in the lighting industry that lighting fixtures mountable on ceiling or wall surfaces, especially those designed to be recessed in such surfaces, may become fire hazards under certain circumstances. Fires have been known to occur when too large wattage lamps are used in the lighting fixtures and/or where insulation surrounding the fixture prevents heat produced thereby from properly dissipating.

One attempt to overcome the aforementioned difficulties has been made by including in each lamp socket of a lighting fixture, a thermal protector which interrupts current to the socket when the socket is heated to a predetermined temperature, see U.S. Pat. No. 4,131,868, entitled incandescent Lamp Socket Having Over-Temperature Protector, issued Dec. 26, 1978.

While the thermally protected socket described in the aforementioned patent attempts to address the problems discussed heretofore, the socket arrangement is not sufficiently versatile for use with recessed lighting fixtures which can accommodate various types of trim rings, and/or reflectors and refractors which can alter the heat dissipation of the lighting fixture. Also, the placement of the thermal protector in the lamp socket can cause unnecessary cycling of the lamp between on and off conditions when in fact the actual temperature of the area surrounding the fixture is well below that which is deemed a fire hazard. Furthermore, the thermal protector included as a part of the socket can easily be circumvented, thereby rendering the protection it is intended to provide, ineffective.

The need for thermal protective devices in lighting fixtures, especially those which are to be recessed in ceiling or wall surfaces, has been recognized by certain organizations concerned with safety, such as, for example, Underwriter's Laboratory and the National Fire Prevention Association. It is believed that devices which can be rendered ineffective easily will not, however, be acceptable to such organizations.

SUMMARY OF THE INVENTION

Accordingly, it is a primary object of the present invention to provide a new and improved thermal protective device for use with lighting fixtures, which device is designed to accommodate specific heat dissipation characteristics of such lighting fixtures and which avoids the drawbacks of the prior art thermal protector discussed heretofore.

It is another object of the invention to provide a thermal protective device of the above mentioned type which is designed for use with recess mounted lighting fixtures.

It is yet another object of the present invention to provide a thermal protective device for lighting fixtures which is effective in operation, not easily circumvented and which adds a relatively low cost to the lighting fixture with which it is used.

Briefly, a preferred embodiment of the thermal protective device according to the invention includes a receptacle having mounted therein, first and second female terminals for connection via electrical wiring into the circuit of the lamp socket of a lighting fixture with which it is used. A normally open switch contact included in the receptacle is connected to the "hot" side of the circuit. The switch contact includes a specially formed, movable contact arm normally disengaged from a stationary contact connected to one of the female terminals of the receptacle, thus normally rendering the lamp circuit "open."

A plug includes a thermal protector designed to open at a predetermined temperature. The thermal protector includes a bimetallic element which operates a movable contact arm electrically connected across a pair of male terminals extending from the plug. In addition to the male terminals, an insulative switch actuator and latch member extends from the plug.

To activate the circuit and simultaneously introduce the thermal protector thereinto, male terminals of the plug are inserted into the female terminals of the receptacle. Upon insertion, the switch actuator and latch member is also received in an opening in the receptacle and engages the contact arm of the switch contact to close the switch, thereby completing the circuit through the movable contact arm of the thermal protector. The latch portion of the actuator and latch member engages the specially formed end of the contact arm, thereby to prevent disconnection of the plug and receptacle, making circumvention of the thermal protective device virtually impossible, short of destruction of the device or severing of the electrical leads connected thereto.

In actual practice, particularly in the case of a recessed lighting fixture, the fixture housing including the lamp socket(s) is provided with a receptacle wired thereinto and extending therefrom. A trim ring or the like selected for use with the fixture housing, is provided with a plug including a thermal protector selected specifically for use with that trim ring and fixture housing and operable to "open" the lamp circuit at a predetermined temperature. The temperature cut off of the thermal protector is thus selected in accordance with the heat dissipation of the light fixture calculated therefore when the fixture including the accompanying trim ring, is mounted properly in a ceiling or the like surface. Because different trim ring-light fixture housing combinations have different heat dissipation characteristics, selection of a thermal protector as described provides the safety from fire required for such fixtures on an individual basis.

DETAILED DESCRIPTION OF THE DRAWINGS

Figure 1:
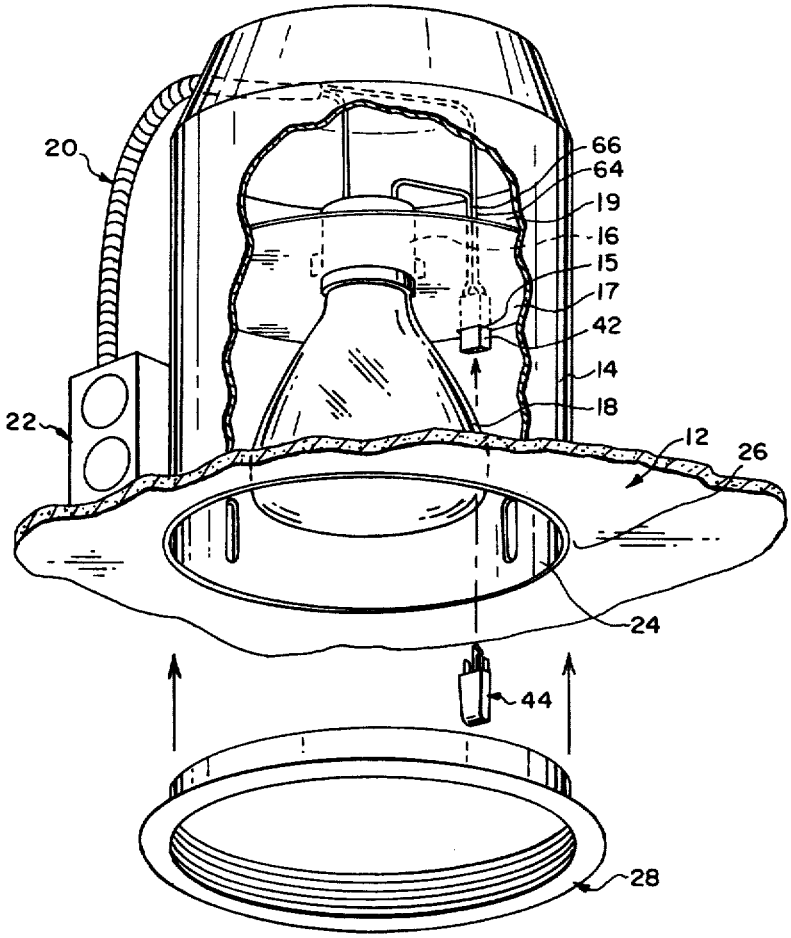
FIG. 1 is an exploded, partially cut away, perspective view of a recess mounted lighting fixture including a thermal protective device according to the invention.

Referring now to the drawings in greater detail wherein like numerals have been employed throughout the various views to designate similar components, there is illustrated in FIG. 1, a lighting fixture designated generally by the numeral 10, including a thermal protective device 40 according to the invention for interrupting current to the lamp circuit of the lighting fixture when the temperature within the fixture housing reaches a predetermined level.

Figure 2:
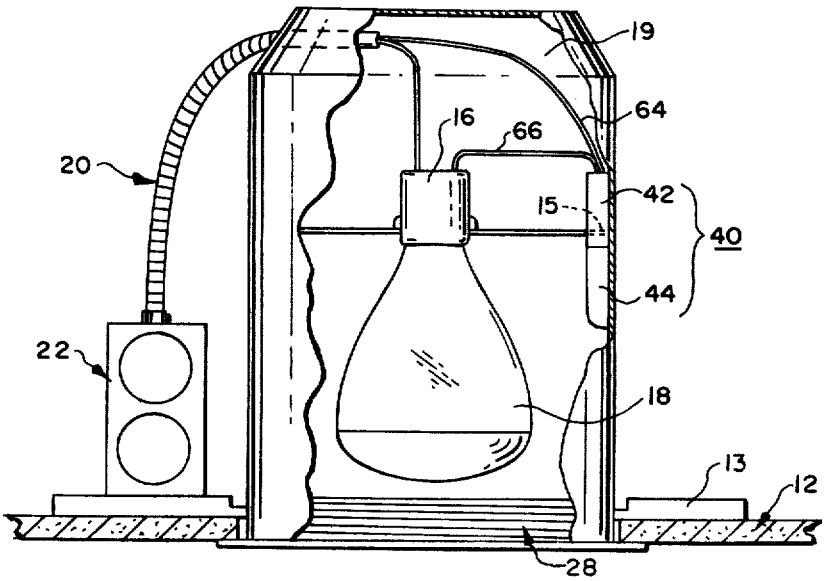
FIG. 2 is partially cut away, side view of the lighting fixture of FIG. 1 shown mounted in recessed fashion on a ceiling surface.
Figure 3:
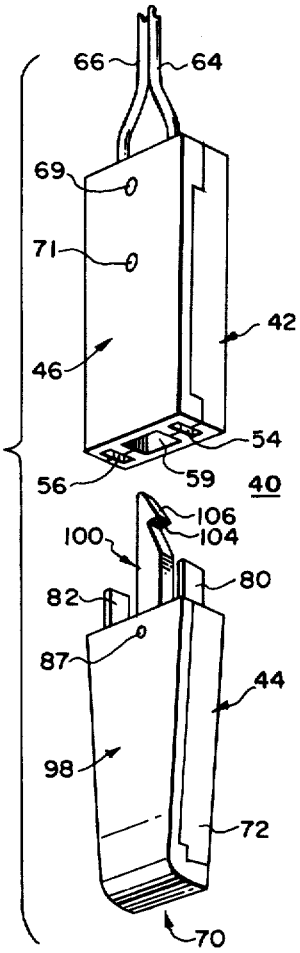
FIG. 3 is an enlarged, prespective view of a thermal protective device according to the invention illustrating the receptacle and plug thereof, shown in an inactive and disassembled condition.

Lighting fixture 10 is of the type which is mounted in recessed fashion in a ceiling or the like surface 12, herein shown installed in a conventional manner with the use of a plaster frame 13, FIG. 2. The lighting fixture is conventional in design, including an enclosed housing 14 of a particular configuration; the fixture housing 14 illustrated in the drawings being cylindrical in shape.

Included also in the lighting fixture 10 is a lamp socket 16 mounted on socket plate 17 for receiving a lamp, such as, for example, incandescant lamp 18 illustrated in the drawings. Current is supplied to socket 16 via electrical wiring 20 coupled between socket 16 and an electrical junction box 22 supplied with electrical power by additional wiring (not shown) coupled to a power source. Socket plate 17, which is mounted within housing 14, also serves as a divider to form an enclosed wiring compartment 19. Wiring compartment as illustrated in FIGS. 1 and 2 of the drawings, renders the electrical wiring to socket 16 virtually inaccessible without removal of socket plate 17.

As illustrated in FIG. 1, the open end 24 of lighting fixture housing 14 is flush with the outer surface 26 of ceiling 12. A trim ring 28 or similar attachment is adapted for receipt over open end 24 of the housing. Trim ring 28 while serving the purpose of rendering the lighting fixture more aesthetically pleasing, also aids in dispersing or diffusing light from lamp 18 outwardly into a room in which the lighting fixture is employed. In some instances other attachments, such as, for example, refractors designed to concentrate light from lamp 18 on an object or to direct the light in a predetermined pattern, are used in place of trim ring 28. It has been found that the use of different trim rings, refractors, concentrators and the like, alter the heat dissipation of the lighting fixture. Accordingly, temperature levels within and about the fixture housing will vary with different combinations. In addition to a change in trim ring, refractor or the like, insulation (not shown) provided within the ceiling structure about the exterior of housing 14 can also alter the heat dissipation of the lighting fixture. Insulation added about the fixture housing may restrict heat dissipation sufficiently to cause the fixture to become a fire hazard.

To prevent overheating of the lighting fixture within ceiling surface 12 and thereby avoid a potential fire hazard, thermal protective device 40 according to the invention has been included in the lamp circuit of the lighting fixture 10. The thermal protective device 40 can best be seen in FIGS. 3-7 of the drawings.

Thermal protective device 40 comprises a receptacle 42 and a plug 44. Receptacle 42 includes an outer casing 46 formed of insulative plastic or the like material. Casing 46 includes a base portion 48 (FIG. 7) defining predeterminedly shaped recesses 50, 52 for receiving female terminals 54, 56, respectively. A specially designed contact switch assembly 58 is also mounted in recess 50. Contact switch assembly 58 includes a stationary contact 60 connected to female terminal 54 and a movable contact arm 62, normally biased away from stationary contact 60. The free end 63 of contact arm 62 is bent back on itself to form a hook portion 65, the front surface 67 of which serves as a cam, the purpose of which will be discussed hereinafter. Contact arm 62 is coupled to an electrical wire 64 by soldering or the like. Wire 64 is in turn coupled into the circuit of socket 16 of the lighting fixture, as illustrated in FIG. 1. A second electrical wire 66 coupled to female terminal 56 is also connected into the circuit of the socket 16 of the lighting fixture. An insulative cover portion 68 of casing 46 is received on base 48 to enclose recesses 50, 52 and to secure the terminals 54, 56 and contact switch 58 in place in the casing. Pins 55 and 61 extending upwardly from base portion 48 are received in aligned apertures 69, 71, respectively, in cover portion 68 to join the base and cover portions. Once cover portion 68 is joined to base portion 48, contact switch assembly 58 is accessible only through an opening 59 defined in receptacle 42 between female terminals 54, 56. Cover portion 58 is secured to base portion 48 by sonic welding, gluing or the like.

Plug 44 of the thermal protective device includes a casing 70 of insulative material. Casing 70 includes a base portion 72 defining recesses 74, 76 and 78 for accommodating male terminals 80, 82 and a thermal protector or temperature sensitive switch herein illustrated as including movable contact arm 84 coupled electrically between the aforementioned male terminals and electrically energized or de-energized by thermal mechanical force exerted by a bimetallic snap-acting temperature sensing element 87 located in recess 78 of base portion 72.

Figure 6:
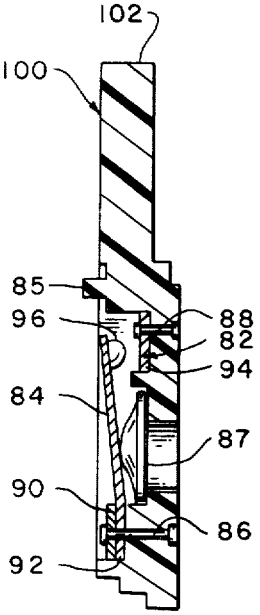
FIG. 6 is a sectional view of the plug of the thermal protective device of FIG. 4 taken along the line 6—6.
Figure 7:
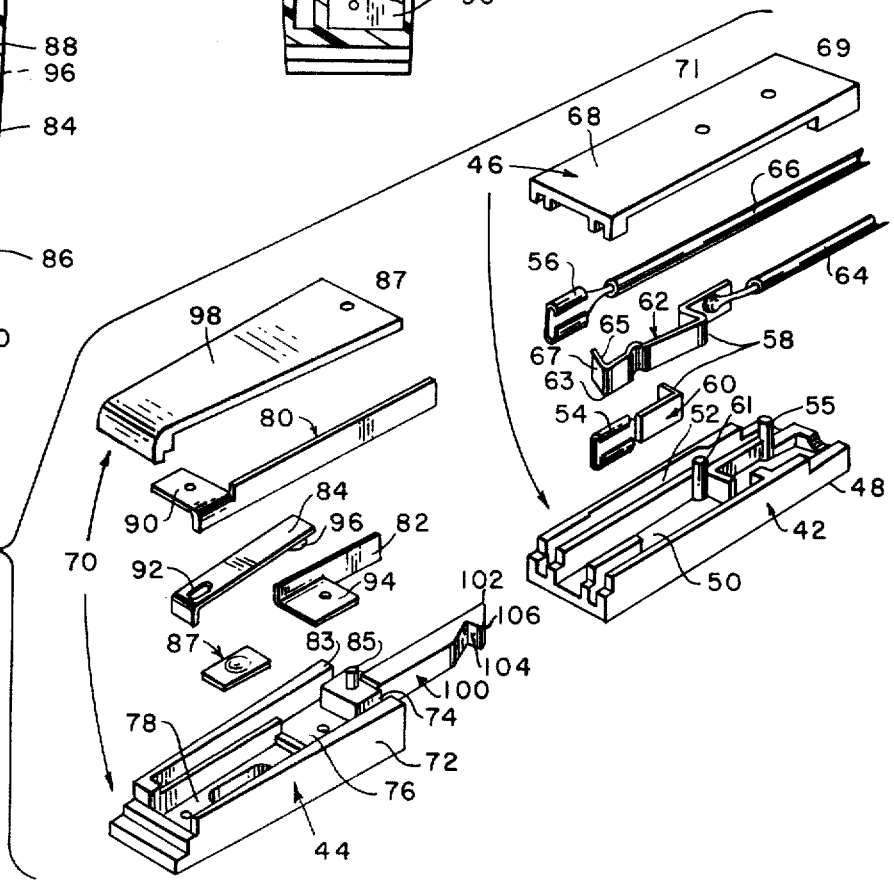
FIG. 7 is an exploded, prespective view of the thermal protective device according to the invention illustrating the various components incorporated therein.

The male terminals and movable contact arm 84 are secured in place in the base portion 72 of plug 44 by fasteners, such as pins 86, 88 (see FIG. 6). Pin 86 joins coupled ends 90 and 92 of terminal 80 and movable contact arm 84, respectively, to the base portion and pin 88 joins end 94 of terminal 82 to the base portion at a predetermined location whereat end 94 is aligned with the movable contact end 96 of the movable contact arm 84. Movable contact arm 84 operates in a conventional manner; i.e. contact 96 is normally in contacting engagement with end 94 of terminal 82, thereby completing an electrical path between male terminals 80, 82. When the surrounding temperature reachs a predetermined level, bimetallic element 87 is thermally stressed causing it to deform in a direction toward contact arm 84. The bimetallic element, as shown in FIG. 6, urges the contact arm 84 away from terminal 82, moving contact 96 away from end 94 of terminal 82, thereby breaking electrical connection between the male terminals.

Figure 4:
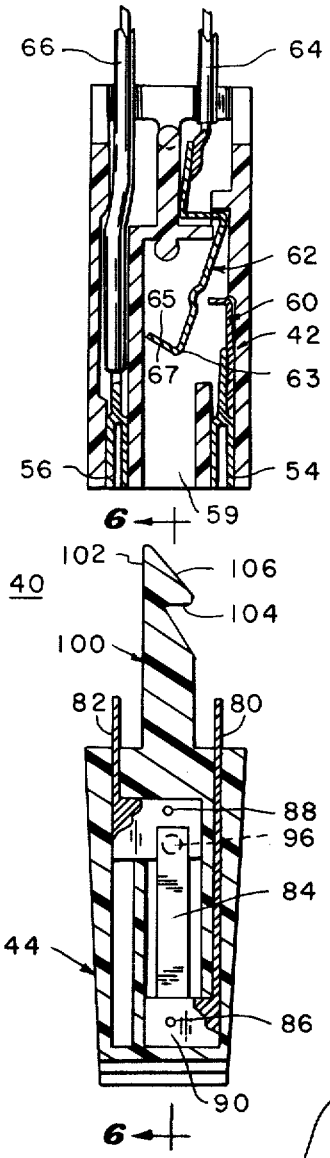
FIG. 4 is a top sectional view of the thermal protective device of FIG. 3.
Figure 5:
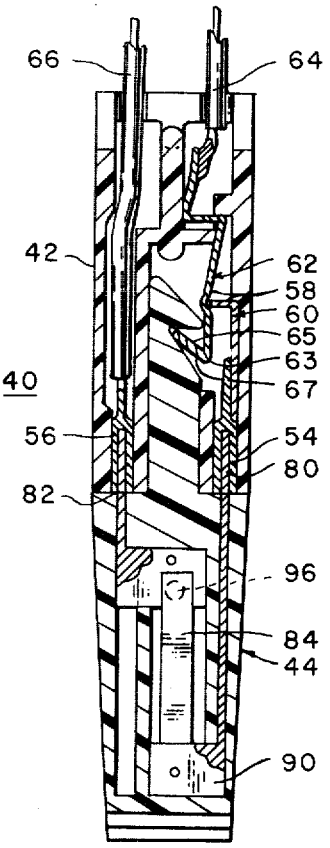
FIG. 5 is a top sectional view of the thermal protective device of FIG. 3 illustrating the receptacle and plug in an assembled active condition.

An insulative cover portion 98 is joined to base portion 72 to enclose the movable arm 84 and bimetallic element 87 and male terminals 80, 82 within the plug. When joined, pin 85 extending upwardly from base portion 72, is received in an aligned aperture 87 of cover portion 98. Cover portion 98 is secured to the base portion by sonic welding, gluing or the like. The free ends of male terminals 80, 82 extend outwardly from end 83 of plug 44 and are positioned for receipt in female terminals 56, 54, respectively, or receptacle 42, as illustrated in FIGS. 4 and 5 of the drawings.

Also extending from end 83 of the plug 44 between male terminals 80, 82, is an actuator and latch arm 100 formed intregally with base portion 72. Actuator and latch arm 100 is provided to cooperate with contact switch arm 62 of contact switch assembly 58 in receptacle 42, for closing the contact switch and thereby completing a circuit to the thermal protector in plug 44.

Formed at the extreme free end 102 of actuator and latch arm 100 is hook portion 104. The free end of arm 100 also includes a cam surface 106.

In practice, each lighting fixture 10 includes a receptacle 42 prewired into the lamp circuit thereof via wires 64, 66, see FIGS. 1 and 2. The receptacle is mounted in an aperture 15, FIG. 1, defined in socket plate 17 so that wires 64, 66 extending into the receptacle remain enclosed in wiring compartment 19 of the fixture housing. In this fashion tampering with the wires connected to receptacle 42 and to socket 16, is made virtually impossible short of destruction of the fixture housing. Thus, circumvention of the thermal protective device is made exceedingly difficult.

Each trim ring, 28, refractor, reflector, concentrator, or the like attachment designed for use with the lighting fixture housing, is provided with a plug 44 including a thermal protector, operable from a closed to an open condition at a predetermined temperature; the temperature level being preselected based upon a determination of the heat dissipation of a lighting fixture including a particular trim ring or the like attachment, when no insulation surrounds the lighting fixture housing.

Accordingly, after lighting fixture housing 14 is installed in a ceiling surface as shown in FIGS. 1 and 2, plug 44 accompanying the selected trim ring 28, or the like attachment, is inserted into receptacle 42. Upon insertion, male terminals 80, 82 engage female terminals 56, 54, respectively, and actuator and latch arm 100 deflects contact arm 62 of the contact switch assembly 58, causing the contact switch arm to engage the stationary contact 60, thereby completing the lamp circuit through now fully inserted male terminals, to the thermal protector. As the actuator and latch arm 100 is inserted into receptacle 42, cam surfaces 106 and 67 are engaged, thereby urging contact arm 62 toward stationary contact 60. Thereafter, hook portions 104 and 65 of actuator and latch arm 100 and contact switch arm 62, respectively are interlocked to retain the plug and receptacle in a joined condition. Once joined, hook portions 104 and 65, secure the plug and receptacle so that they cannot be disengaged without destruction of the thermal protective device 40. In this manner, protection from overheating provided by the device virtually cannot be circumvented.

Thus, it can be seen from the foregoing description that the thermal protective device according to the invention provides protection to lighting fixtures from over heating and thus from becoming potential fire hazards. Each thermal protective device is selected in accordance with the heat dissipation determined for particular style of lighting fixture including fixture housing and trim ring, refractor and the like variations.

It should be noted that while receptacle 42 has been described herein as including female terminals 54, 56 and plug 44 has been described herein as including male terminals 80, 82, it is possible to reverse the terminals with respect to the receptacle and plug and still fall within the scope of the present invention. It should be understood also that the other modifications may be made in the thermal protective device according to the invention.

In addition to the latter, it will be clear to one skilled in the art that the thermal protective device according to the invention may be used successfully with other heat generating, electrically operated appliances which could pose a fire hazard from overheating.

It is therefore contemplated to cover by the present application any and all such modifications and applications as fall within the true spirit and scope of the appended claims.

I claim:

1. A device for interrupting current to the electrical circuit of an electrically operated, heat generating appliance such as, an electrical lighting fixture when the temperature at a preselected location in said appliance reaches a predetermined level, said device including in combination;

a receptacle located generally at said preselected location including first terminal means connected electrically to said circuit;

a plug adapted for joinder with said receptacle including second terminal means connectable with said first terminal means upon joining said receptacle and plug and thermal protector means connected electrically to said second terminal means, said thermal protector means being operable to open said circuit at said predetermined temperature level; and latch means included in said receptacle and plug, operable to secure said receptacle and plug in disengagable relation in response to the engagement of said first and second electrical terminal means.

2. A device for interrupting current to the electrical circuit of an electrically operated, heat generating appliance, such as an electrical lighting fixture, as claimed in claim 1 wherein said receptacle includes switch means coupled to said first terminal means for normally maintaining said circuit in an electrically disconnected condition, said switch means being operable to electrically complete said circuit in response to the connection of said first and second terminal means.

3. A device for interrupting current to the electrical circuit of an electrically operated, heat generating appliance, such as, an electrical lighting fixture, as claimed in claim 2 wherein said switch means includes a movable contact arm and a stationary contact, said contact arm being biased away from said stationary contact and wherein said plug further includes actuator means receivable by said receptacle, said actuator means positioned for cooperative engagement with said contact arm upon joinder of said plug and receptacle for moving said contact arm into contacting engagement with said stationary contact.

4. A device for interrupting current to the electrical circuit of an electrically operated, heat generating appliance, such as, an electrical lighting fixture as claimed in claim 3 wherein said switch arm includes a first latch portion and wherein said actuator means includes a second latch portion, said first and second latch portions being disengageably coupled upon joinder of said receptacle and plug.

5. A device for interrupting current to the electrical circuit of an electrically operated, heat generating appliance, such as, an electrical lighting fixture as claimed in claim 4, wherein said actuator means comprises an insulative arm member extending outwardly from said plug, said arm member including a cam surface and first hook means, wherein said receptacle defines an opening for receiving said arm member and wherein said contact arm of said switch means includes a cam surface positioned for engagement by said cam surface of said arm member of said actuator means upon insertion of said arm member into said opening of said receptacle and second hook means for engagement with said first hook means, said contact arm being urged into engagement with said stationary contact in response to the engagement of said cam surfaces and said first and second hook means being latched together to disengageably couple said plug and receptacle.

6. A thermal protective device for use with an electrical lighting fixture or other electrically operated, heat generating appliance, adapted to be mounted on a ceiling or other support surface for interrupting current to the electrical circuit of the appliance when the temperature at a preselected location within said appliance reaches a predetermined level, said thermal protective device including in combination:

a receptacle positioned generally at said predetermined location including an enclosed casing of insulative material having mounted therein, first terminal means connected electrically to said circuit, said receptacle further including normally open switch means interposed between said first terminal means and said circuit for maintaining said circuit in an electrically disconnected condition, said switch means comprising a contact arm and stationary contact, said contact arm being movable into contacting engagement with said stationary contact, said contact arm further including first latch means, said casing defining an opening aligned with said switch contact arm;

a plug adapted for joinder with said receptacle including an enclosed casing of insulative material having mounted therein, second terminal means connectable with said first terminal means upon joinder of said receptacle and plug and a thermal protector connected electrically to said second terminal means, said thermal protector being operable to open said circuit at said predetermined temperature level; and insulative actuator means extending from said casing of said plug, dimensioned for receipt in said opening of said casing of said receptacle for cooperative engagement with said switch contact arm, said actuator means urging said switch contact arm into engagement with said stationary contact upon joinder of said receptacle and plug, said actuator means further including second latch means engageable with said first latch means of said contact switch arm for disengageably connecting said receptacle and plug.

7. A thermal protective device as claimed in claim 6 wherein said contact arm of said switch means includes a reversely bent end portion defining a cam surface and hook portion and wherein said actuator means includes an arm member having an end portion defining a cam surface and hook portion, said cam surface of said actuator arm member engaging said cam surface of said contact arm in response to the joinder of said receptacle and plug for urging said contact arm into contacting engagement with said stationary contact, said hook portion of said actuator arm member thereby engaging said hook portion of said contact arm of said switch means for disengagably connecting said receptacle and plug.

8. A thermal protective device as claimed in claim 6, wherein said first terminal means includes first and second female terminals between which said opening is defined, wherein said contact arm of said switch means is mounted within said casing of said receptacle in alignment with said opening, wherein said second terminal means includes first and second male terminals arranged for receipt by said female terminals upon joinder of said receptacle and plug and wherein said actuator means includes an insulative arm extending outwardly from said casing of said plug between said first and second male terminals for receipt in said opening of said casing of said receptacle in contacting engagement with said contact arm of said switch means.

9. A thermal protective device as claimed in claim 6, wherein said casing of said receptacle comprises a base portion defining recesses for receiving said first terminal means and said switch means, and a cover portion joined to said base portion in overlying relation for securing said first terminal means and switch means therein, wherein said casing of said plug comprises a base portion defining recesses for receiving said second terminal means and thermal protector and a cover portion joined to said base portion in overlying relation for securing said second terminal means and said thermal protector therein and wherein said first terminal means comprises a pair of female terminals enclosed in said casing of said receptacle and said second terminal means comprises a pair of male terminals, only the free ends of which extend from said casing of said plug for receipt by said female terminals.

10. A thermal protective device for use with an electrical lighting fixture adapted for mounting on a ceiling or the like support surface in recessed fashion with respect thereto and including a housing having a lamp socket to which current is supplied from a source of power for illuminating a lamp received therein, said housing being fabricated for receipt of one of a plurality of light diffusing attachments, said thermal protective device interrupting current through the lamp socket of said lighting fixture when the temperature at a preselected location within said housing reaches a predetermined level, said predetermined temperature level being determined in part by the light diffusing attachment selected for use with said housing, said thermal protective device including in combination:

a receptacle positioned within said housing generally at said predetermined location including an enclosed casing of insulative material having mounted therein first terminal means connected electrically to said lamp socket;

a plug arranged for connection with said receptacle, said plug including an enclosed casing of insulative material having mounted therein, second terminal means connectable with said first terminal means upon joinder of said receptacle and plug and a thermal protector connected electrically to said second terminal means, said thermal protector being operable to discontinue the supply of current from said power source to said lamp socket at said predetermined temperature level; and latch means included in said casings of said receptacle and plug, respectively, operable to secure said receptacle and plug in disengagable relation in response to the engagement of said first and second terminal means.

11. A thermal protective device as claimed in claim 10 wherein said receptacle further includes switch means coupled to said first terminal means for normally preventing current from said power source from being supplied to said lamp socket, said switch means being operable to permit the flow of current to said lamp socket in response to the connection of said receptacle and plug.

12. A thermal protective device as claimed in claim 11 wherein said switch means includes a movable contact arm and a stationary contact, said contact arm being biased away from said stationary contact and wherein said plug further includes actuator means receivable by said receptacle, said actuator means positioned for cooperative engagement with said contact arm upon joinder of said plug and receptacle for moving said contact arm into contacting engagement with said stationary contact.

13. A thermal protective device as claimed in claim 12 wherein said switch arm includes a first latch portion and wherein said actuator means includes a second latch portion, said first and second latch portions being disengageably coupled upon joinder of said receptacle and plug.

* * * * *